US007021713B2

(12) United States Patent
Kao et al.

(10) Patent No.: US 7,021,713 B2
(45) Date of Patent: Apr. 4, 2006

(54) SEAT ELEVATING MECHANISM FOR CHAIR

(75) Inventors: Chin-Chin Kao, Hsin Tien (TW); Yu-Yao Lin, Hsin Tien (TW)

(73) Assignee: Dynamic Healthtech Inc, Hsin Tien (TW)

( * ) Notice: Subject to any disclaimer, the term of this patent is extended or adjusted under 35 U.S.C. 154(b) by 161 days.

(21) Appl. No.: 10/807,865

(22) Filed: Mar. 23, 2004

(65) Prior Publication Data

US 2005/0017559 A1 Jan. 27, 2005

(51) Int. Cl.
*A47C 3/20* (2006.01)

(52) U.S. Cl. ..... 297/339; 297/338; 297/DIG. 10

(58) Field of Classification Search ..... 297/311, 297/334, 335, 337, 338, 339, DIG. 10
See application file for complete search history.

(56) References Cited

U.S. PATENT DOCUMENTS

| | | | | |
|---|---|---|---|---|
| 1,025,915 | A * | 5/1912 | Hoff | 297/332 |
| 4,938,533 | A * | 7/1990 | Thielois | 297/337 |
| 5,316,370 | A * | 5/1994 | Newman | 297/313 |
| 5,333,931 | A * | 8/1994 | Weddendorf | 297/334 |
| 5,626,389 | A * | 5/1997 | Logan, Jr. | 297/250.1 |
| 6,213,554 | B1 * | 4/2001 | Marcoux et al. | 297/DIG. 10 |
| 6,851,751 | B1 * | 2/2005 | Romero et al. | 297/331 |
| 6,871,910 | B1 * | 3/2005 | Hale | 297/DIG. 10 |

* cited by examiner

*Primary Examiner*—Peter R. Brown
(74) *Attorney, Agent, or Firm*—W. Wayne Liauh

(57) ABSTRACT

A seat elevating mechanism for chair particularly designed for old men and patients having weak legs mainly includes a seat that can be elevated or lowered using a power-actuated telescopic lifter. The seat is maintained in a horizontal position while being elevated or lowered, so that a user may stably sit thereon until the seat is fully elevated or lowered to enable the user to get up or sit down effortlessly.

2 Claims, 5 Drawing Sheets

SEAT ELEVATING MECHANISM FOR CHAIR

FIELD OF THE INVENTION

The present invention relates to a seat elevating mechanism for chair designed to provide a supporting force that helps old men and patients to get up from or sit on a chair effortlessly.

BACKGROUND OF THE INVENTION

An old man or a patient with weak legs and slow movement has difficulty in sitting on a chair safely and effortlessly, and therefore frequently needs help of an attendant to sit on the chair. It is even more laborious for the old man or the patient having injured or weak legs to get up from the chair, particularly when there is not an attendant.

There are chairs with an elevating seat available in the market designed for the aged and some patients. The elevating seats of these conventional chairs are slightly higher than that of other normal chairs, and are therefore not comfortable for sitting. Since the conventional elevating seats are normally elevated using an air pump, the users still need to exert strength at two legs to get up from the elevated seats. Another disadvantage of the conventional elevating seats is the seats are forward and downward inclined when being elevated, preventing the users from stably sitting thereon. The conventional chairs with elevating seats are therefore not safe and inconvenient for use.

SUMMARY OF THE INVENTION

A primary object of the present invention is to provide a seat elevating mechanism for chair, in which the seat of the chair is electrically driven to elevate, so that a user may stably sit thereon while the seat is gradually elevated and horizontally moved forward, and may get up from the chair effortlessly when the elevated seat reaches at a desired height.

The seat elevating mechanism for chair according to the present invention includes a chair, a two-piece seat, a seat support, and a telescopic lifter. The seat support includes a mounting bracket fixedly mounted to a front side of the chair, and a seat-board supporting frame having front and rear portions for supporting front and rear seat boards, respectively, to a top thereof. The front and the rear portion of the seat-board supporting frame are pivotally connected to one another at two laterally spaced pivoting points. The telescopic lifter may be actuated to push the rear portion of the seat-board supporting frame upward, so that the seat-board supporting frame and the seat boards thereon are elevated and horizontally moved forward, allowing a user stably sit thereon to get up easily.

In the seat elevating mechanism for chair according to the present invention, the rear portion of the seat-board supporting frame is always in a horizontal position in the course of elevating or lowering, allowing the user to stably sit thereon.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
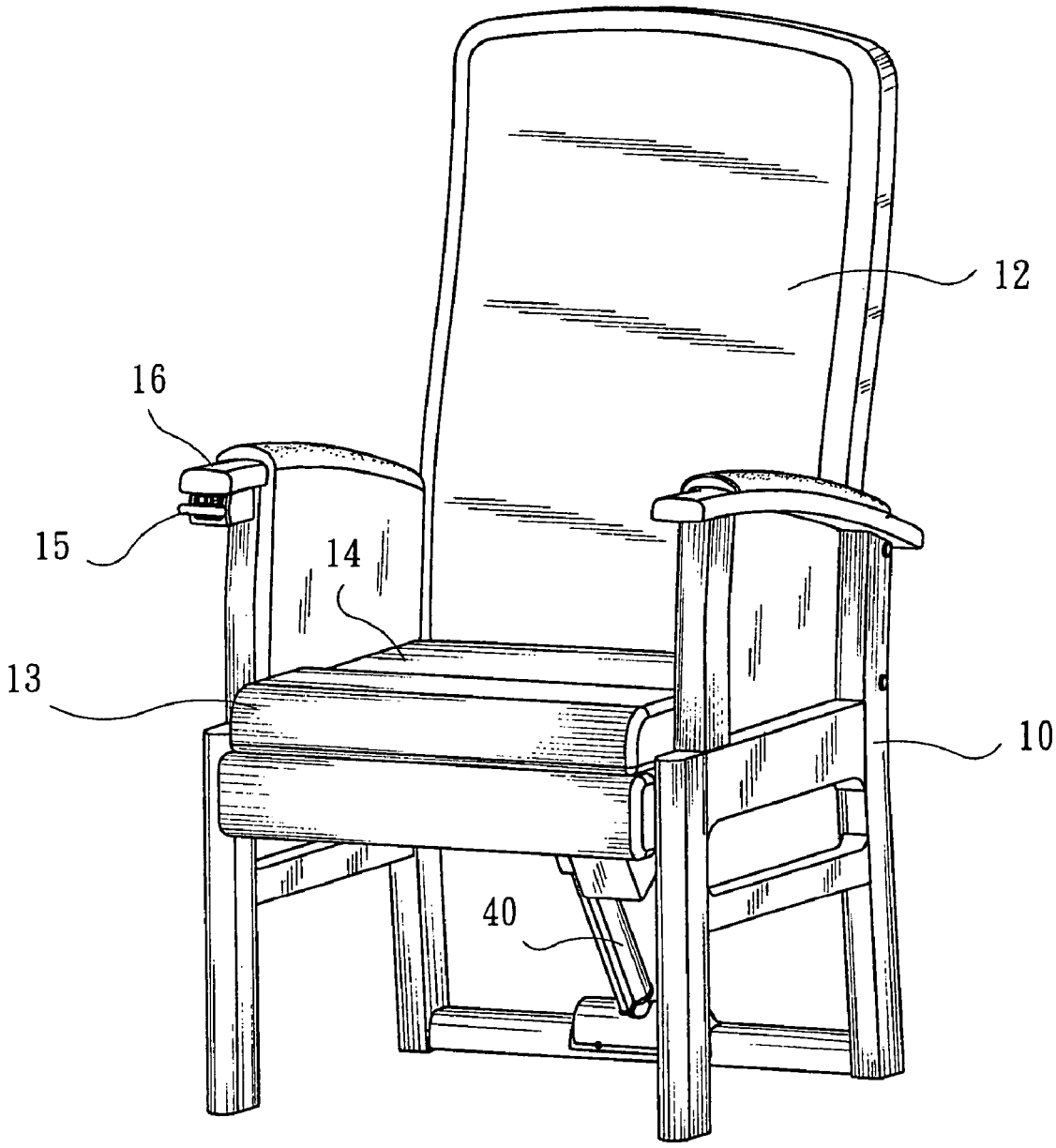
FIG. 1 is a front perspective view of a chair with a seat elevating mechanism according to the present invention, wherein the seat is in a fully lowered position.
Figure 2:
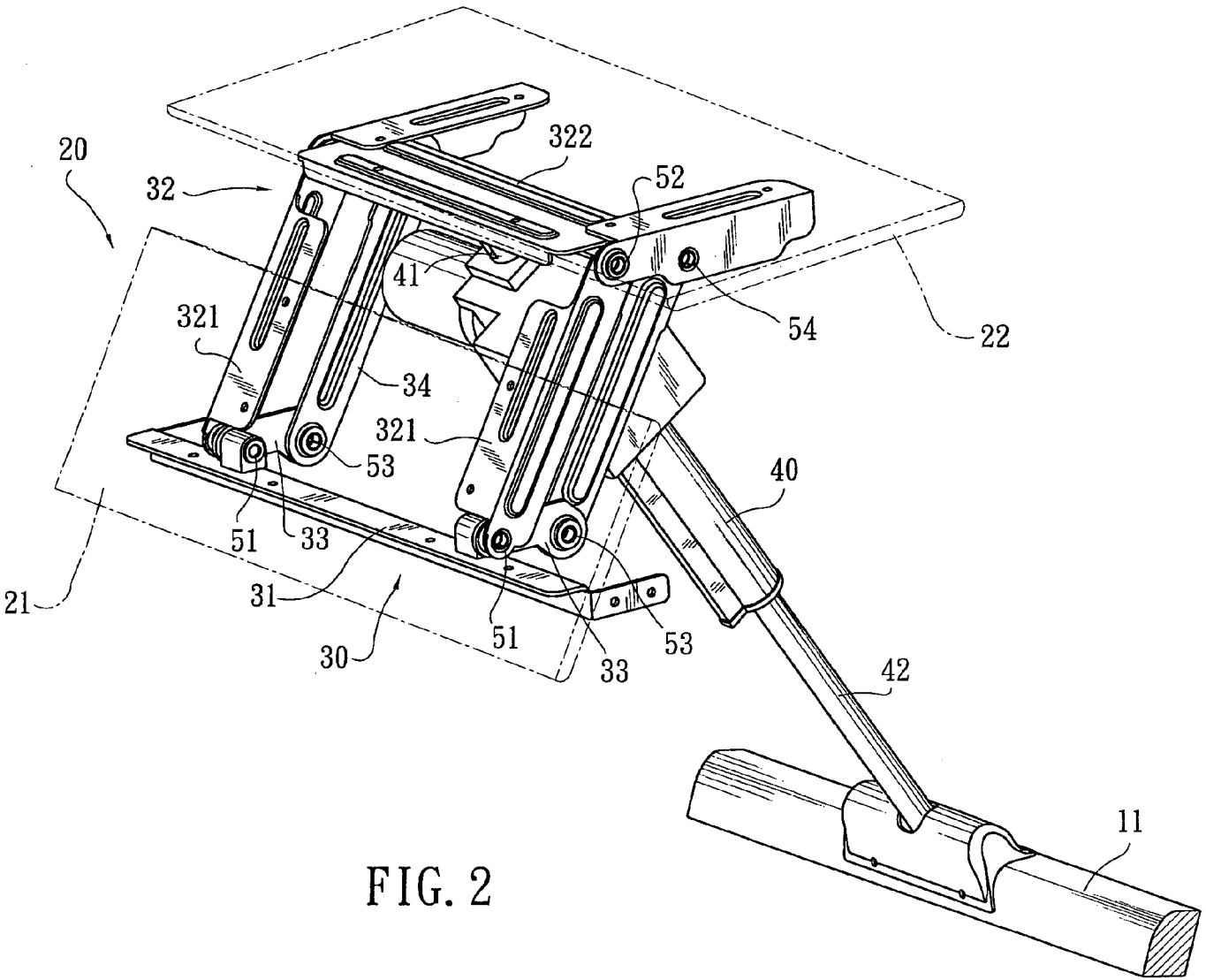
FIG. 2 is a partially phantom view showing the structure of the seat elevating mechanism of the present invention, wherein the seat elevating mechanism is in an elevated position.

Please refer to FIGS. 1 and 2. The present invention relates to a seat elevating mechanism for a chair 10. As shown, the set elevating mechanism mainly includes a two-piece seat 20 consisting of a front and a rear seat board 21, 22, a seat support 30, and a telescopic lifter 40.

The seat support 30 includes a mounting bracket 31 fixedly mounted to a front side of the chair 10 at a predetermined position, a seat-board supporting frame 32 for supporting the two seat boards 21, 22 to a top thereof, two laterally corresponded horizontal arms 33 fixedly connected at one end to the fixed mounting bracket 31, and two links 34.

The whole seat-board supporting frame 32 is pivotally connected at a front side to the fixed mounting bracket 31, so as to pivotally turn about two pivoting points 51 relative to the mounting bracket 31. The seat-board supporting frame 32 includes a front and a rear portion 321, 322 that are pivotally connected to one another at two laterally spaced pivoting points 52, and respectively support the front and the rear seat boards 21, 22 thereon.

Each of the two links 34 has a first end pivotally connected to a free end of one of the horizontal arms 33 to turn about a pivoting point 53, and a second end pivotally connected to the rear portion 322 of the seat-board supporting frame 32 to turn about a pivoting point 54, such that the pivoting points 51 for the front side of the seat-board supporting frame 32 and the fixed mounting bracket 31, the pivoting points 52 for the front and the rear portion 321, 322 of the seat-board supporting frame 32, and the pivoting points 53, 54 for the two ends of the links 34 together form four points of a parallelogram.

The telescopic lifter 40 includes a base 41 pivotally connected to the rear portion 322 of the seat-board supporting frame 32 at a predetermined point, and an extendable pipe 42 having an outer end pivotally connected to a rear bottom crossbar 11 of the chair 10 at a predetermined point. When the telescopic lifter 40 is actuated, it pushes the rear portion 322 of the seat-board supporting frame 32 upward and thereby elevates the seat 20 supported on the seat-board supporting frame 32 while moving the seat 20 forward, enabling a person sitting on the seat 20 to get up easily.

Figure 3:
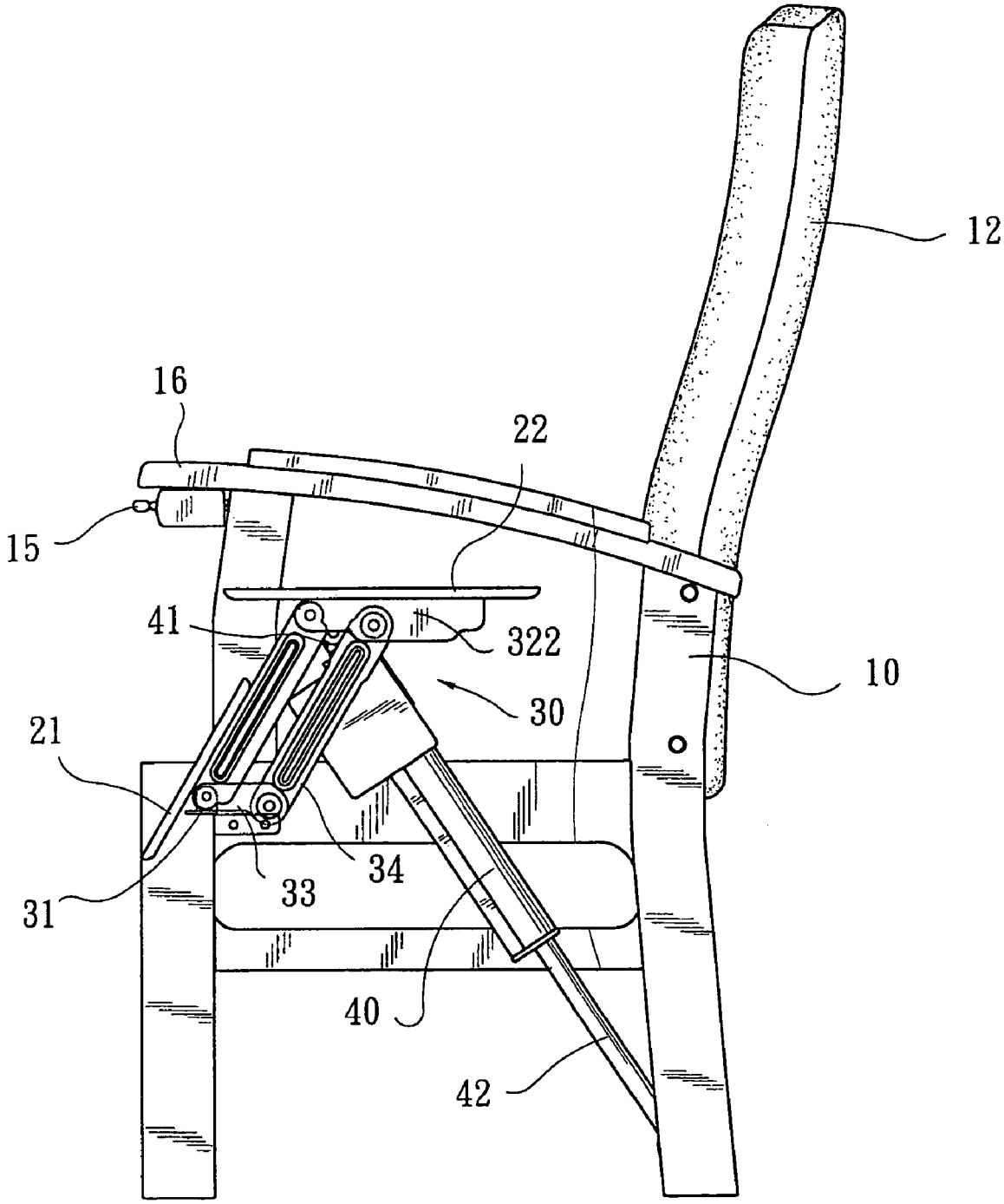
FIG. 3 is a partially sectioned side view showing the seat elevating mechanism of the present invention in the elevated position.

Please refer to FIG. 3. When the extendable pipe 42 of the telescopic lifter 40 is extended, the seat-board supporting frame 32 is elevated. Since the above-mentioned four pivoting points 51, 52, 53, and 54 form four points of a parallelogram, the rear portion 322 of the frame 32 is always in parallel with the horizontal arms 33, which are fixedly connected to the mounting bracket 31. And, since the horizontal arms 33 are horizontally fixedly mounted on the chair 10, the rear portion 322 of the seat-board supporting frame 32 is always in a horizontal position, allowing a user, particularly an old man to sit on the seat 20 stably. When the telescopic lifter 40 gradually pushes the seat 20 upward, the front portion 321 of the seat-board supporting frame 32 is turned about the pivoting points 51 at the front side of the seat-board supporting frame 32, bringing the rear portion 322 to gradually move forward while being elevated, and enabling the old man to get up from the seat more easily.

Figure 5:
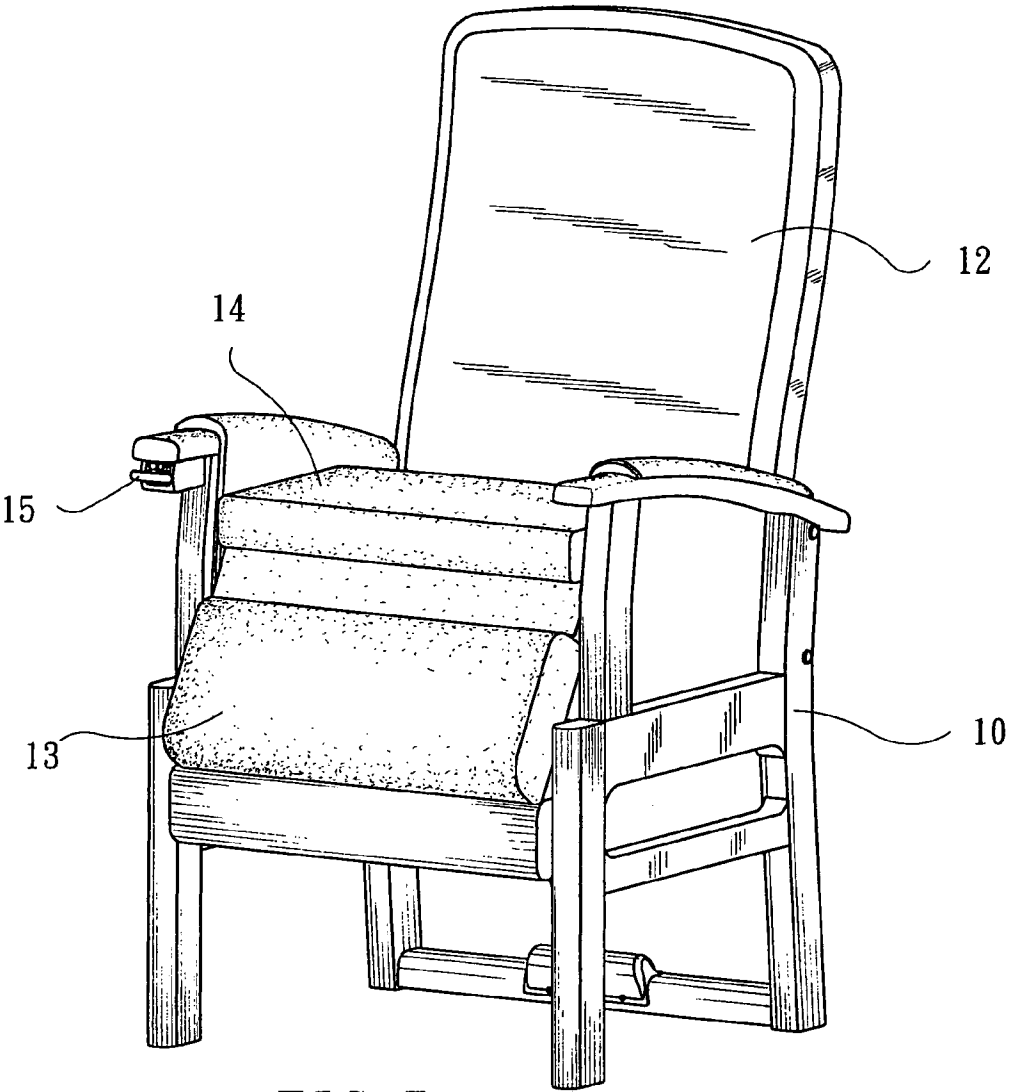
FIG. 5 is a front perspective view of the chair of FIG. 1 with the seat in the elevated position.

In practical use of the chair 10, a back cushion 12 is attached to a back of the chair 10, and front and rear seat cushions 13, 14 are separately attached to the two seat boards 21, 22 of the seat 20, so that the chair 10 is more comfortable for sitting. To help an old man to sit on the rear seat cushion 14, first elevate the seat-board supporting frame 32 to a desired height, as shown in FIG. 5, so that the old man's hips are in contact with and slightly seated on the rear seat cushion 14. Then, the telescopic lifter 40 is operated to retract the extendable pipe 42, so that the seat-board supporting frame 32 and the rear seat cushion 14 are gradually lowered for the old man to sit down effortlessly.

Figure 4:
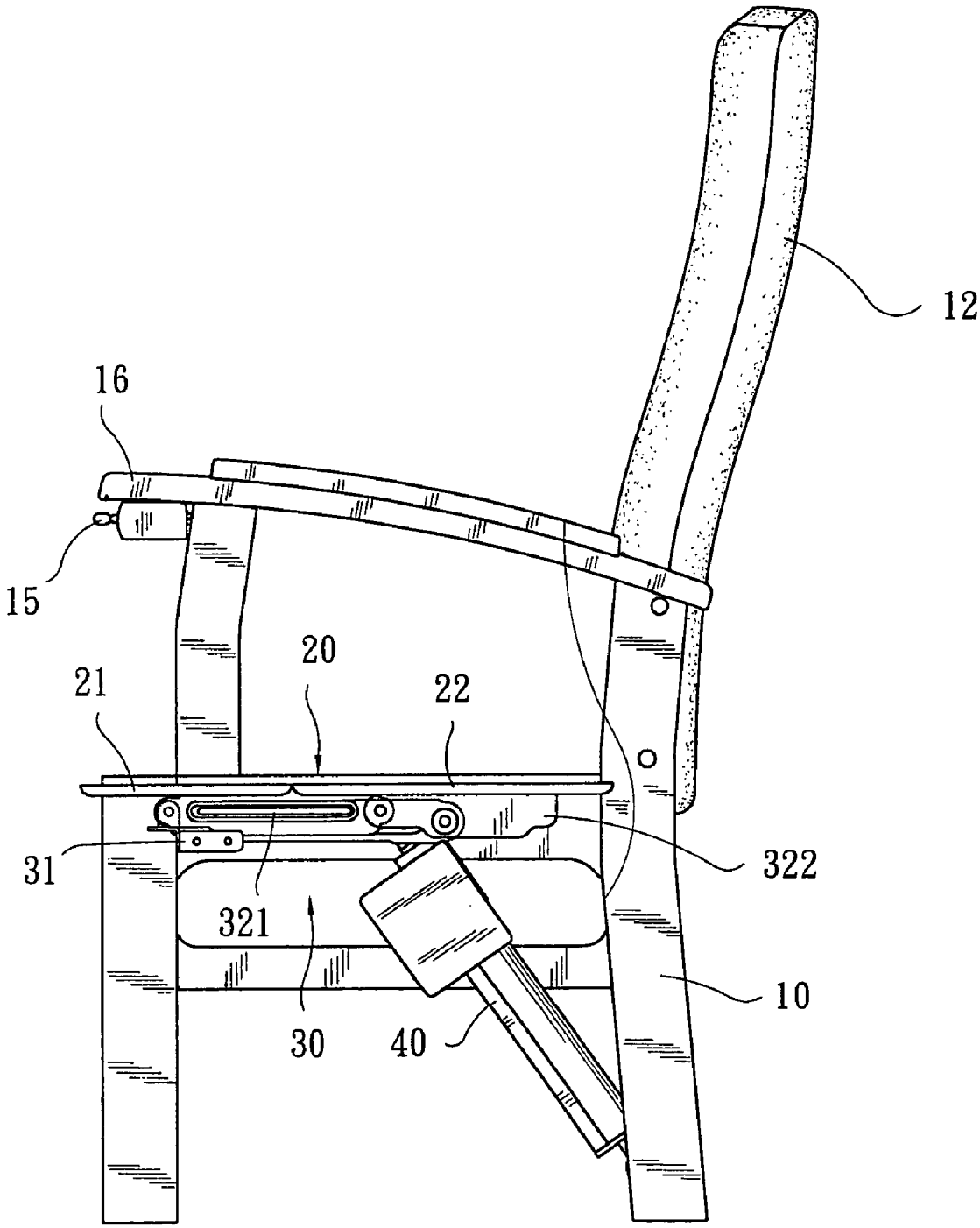
FIG. 4 is a partially sectioned side view showing the seat elevating mechanism of the present invention in a fully lowered position.

The telescopic lifter 40 is a known mechanism, and the extendable pipe 42 is driven to move by an electric motor. When the extendable pipe 42 of the telescopic lifter 40 is caused to retract, a weight must be applied to the telescopic lifter 40 to lower the seat-board supporting frame 32. This design makes the seat elevating mechanism of the present invention safer for use. This type of telescopic lifter 40 is referred to as a passively retractable telescopic lifter 40 and has been widely supplied in the market for many years. More specifically, when the extendable pipe 42 of the telescopic lifter 40 is gradually retracted, a distance by which the seat-board supporting frame 32 is elevated with the telescopic lifter 40 is gradually reduced at the same time. At this point, an overall weight of the user, the frame 32, and the base 41 of the telescopic lifter 40 would cause the seat-board supporting frame 32 to move downward and finally reach a fully lowered horizontal position, as shown in FIG. 4. However, in practical design of the chair 10, it is possible for the seat-board supporting frame 32 to lower under only the weight of the supporting frame 32 and the base 41 when the extendable pipe 42 is operated to retract.

It is preferable to have two laterally corresponded links 34, so that the whole seat elevating mechanism of the present invention may be moved in a stable manner. A switch 15 is provided to a lower front of one armrest 16 of the chair 10 for conveniently controlling the operation of the telescopic lifter 40 by a user.

In brief, the seat elevating mechanism for a chair according to the present invention uses simple linkage for the seat to gradually elevate while maintaining in a horizontal position, so that an old man or a patient may be stably and effortlessly moved to an almost upright position. Moreover, the seat is moved forward while being elevated, allowing the old man or the patient to stand up more easily. Therefore, the present invention actually provides a power-controlled elevating chair very suitable for the aged.

What is claimed is:

1. A seat elevating mechanism for chair, comprising a chair, a two-piece seat, a seat support, and a telescopic lifter;

said seat support including a mounting bracket fixedly mounted on the chair at a predetermined position, two horizontal arms fixedly connected at front ends to said mounting bracket, a seat-board supporting frame for two seat boards of the two-piece seat to connect thereto, and two laterally corresponded links;

said seat-board supporting frame being pivotally connected at a front side to said mounting bracket, so as to turn about two first pivoting points relative to said mounting bracket;

said seat-board supporting frame including a front and a rear portion pivotally connected to one another at two second pivoting points;

said two links being pivotally connected at respective front and rear ends to free ends of said two horizontal arms and two lateral sides of said rear portion of said seat-board supporting frame, respectively, at third and fourth pivoting points, such that said first, said second, said third, and said fourth pivoting points form four points of a parallelogram; and said telescopic lifter including a base pivotally connected to said rear portion of said seat-board supporting frame, and an extendable pipe pivotally connected at an outer end to a rear bottom of said chair;

whereby when said telescopic lifter is actuated, said rear portion of said seat-board supporting frame is elevated while maintaining in a horizontal position.

2. The seat elevating mechanism for chair as claimed in claim 1, wherein said two-piece seat is fixedly provided at a top with seat cushions.

* * * * *